US006010388A

United States Patent [19]

Pillai et al.

[11] Patent Number: 6,010,388

[45] Date of Patent: Jan. 4, 2000

[54] PLASTIC FACE FOR STUFFED TOY ANIMAL

[75] Inventors: Gopala B. Pillai, Solon; Robert T. Wuescher, North Olmsted, both of Ohio; Carolyn M. Tupper, Downingtown, Pa.

[73] Assignee: K&M International, Inc., Twinsburg, Ohio

[21] Appl. No.: 09/283,156

[22] Filed: Apr. 1, 1999

Related U.S. Application Data

[60] Provisional application No. 60/115,763, Jan. 13, 1999.

[51] Int. Cl.[7] ..... A63H 3/02

[52] U.S. Cl. ..... 446/372; 446/391; 446/392

[58] Field of Search ..... 446/372, 369, 446/100, 337, 391, 389, 392, 393, 394

[56] References Cited

U.S. PATENT DOCUMENTS

| | | | |
|---|---|---|---|
| D. 355,683 | 2/1995 | Johnson . | |
| 2,828,581 | 4/1958 | Prupis | 446/393 |
| 4,543,669 | 10/1985 | Katz . | |
| 4,596,528 | 6/1986 | Lewis et al. . | |
| 4,798,556 | 1/1989 | Vicars et al. . | |
| 4,842,566 | 6/1989 | Nagao | 446/345 |
| 5,046,985 | 9/1991 | Cearfoss . | |
| 5,182,845 | 2/1993 | Dean . | |
| 5,328,401 | 7/1994 | DeMars . | |
| 5,520,566 | 5/1996 | Lin . | |
| 5,788,554 | 8/1998 | Goodwin et al. . | |

*Primary Examiner*—Sam Rimell
*Assistant Examiner*—Urszula M. Cegielnik
*Attorney, Agent, or Firm*—Pearne, Gordon, McCoy & Granger LLP

[57] ABSTRACT

A stuffed figure is provided having a detailed plastic face secured to a soft plush head. The soft plush head is formed of a fabric material and is filled with stuffing material. The plastic face includes a face body, a pair of artificial eyes, and a plurality of locking washers. A front side of the face body is contoured to form a mouth, a nose, and eye sockets. A face locking stem is integral with the face body and rearwardly extends from a rear side thereof and through the fabric material. The artificial eyes are each located in a separate one of the eye sockets and may be integral or non-integral with the face body. Each of the artificial eyes has an eye locking stem integral therewith which rearwardly extends therefrom and through the fabric material. The locking washers cooperate with the face locking stem and the eye locking stems to clamp the fabric material between the plurality of locking washers and the rear side of the face body to secure the plastic face to the soft plush head.

20 Claims, 1 Drawing Sheet

PLASTIC FACE FOR STUFFED TOY ANIMAL

This application claims the benefit of U.S. Provisional patent application Ser. No. 60/115,763, filed Jan. 13, 1999.

BACKGROUND OF THE INVENTION

The invention generally relates to stuffed toy animals and, more particularly, to a hard face for a stuffed toy animal and the structure by which the hard face is attached to a featureless fabric head filled with stuffing. The invention can also be utilized in making stuffed toy humans, babies, monsters and other creatures and characters having a head and preferably a torso, arms, and legs.

Numerous stuffed toy animals and other stuffed figures. have been provided which have a face made of a soft plush material similar to that used on the remainder of the head and body. Such plush faces, however, cannot be contoured or colored to provide the necessary facial details for realistic looking stuffed figures.

Various stuffed toy animals and other stuffed figures have also been provided with plastic eyes, noses, and/or mouths which are individually secured to a face made of soft plush material. Such individual features still do not provide the necessary facial details for realistic looking stuffed figures. Additionally, these stuffed figures may not be adequately durable and/or break resistant.

Accordingly, there is a need for a stuffed figure which is realistic looking while at the same time keeping the appeal of a soft touchable plush toy. It is also desired that the stuffed figure be safe, easy to assemble, inexpensive to produce, and very durable and break resistant.

SUMMARY OF THE INVENTION

According to the present invention the stuffed figure. includes a soft head and a hard face secured to the soft head. The soft head is formed of a fabric material and is filled with stuffing material. The hard face includes a face body, a plurality of locking stems, and a plurality of locking washers. The face body has a front side facing away from the soft head and a rear side engaging the soft head. The plurality of locking stems rearwardly extend from the face body and through the fabric material. The plurality of locking washers cooperate with the locking stems to clamp the fabric material between the plurality of locking washers and the rear side of the face body to secure the hard face to the soft head.

According to a preferred embodiment of the present invention the hard face includes a face body, a pair of artificial eyes, and a plurality of locking washers. A front side of the face body is contoured to form a mouth, a nose, and eye sockets. A face locking stem is integral with the face body and rearwardly extends therefrom and through the fabric material. The artificial eyes are each located in a separate one of the eye sockets and are non-integral with the face body. Each artificial eye has an eye locking stem integral therewith which rearwardly extends therefrom and through both the face body and the fabric material. The locking washers cooperate with both the face locking stem and the eye locking stems to clamp the fabric material between the plurality of locking washers and the rear side of the face body to secure the hard face to the soft head.

BRIEF DESCRIPTION OF THE DRAWINGS

These and further features of the present invention will be apparent with reference to the following description and drawings, wherein.

DETAILED DESCRIPTION OF THE PREFERRED EMBODIMENTS OF THE INVENTION

Figure 1:
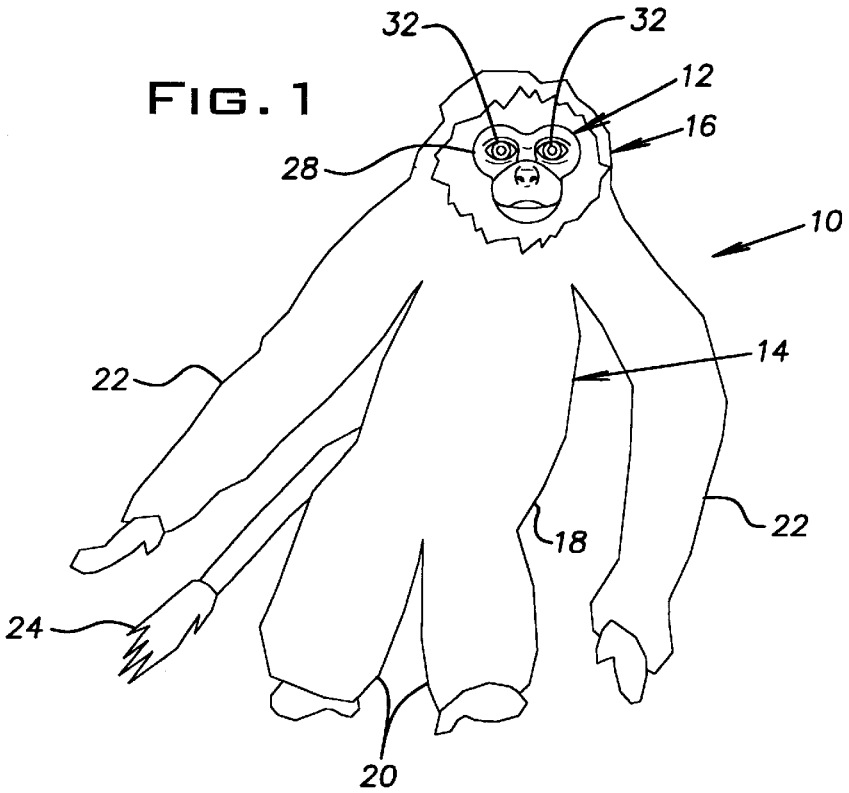
FIG. 1 is a perspective view of a stuffed figure or toy animal having a hard face secured to a soft plush head according to the present invention.
Figure 2:
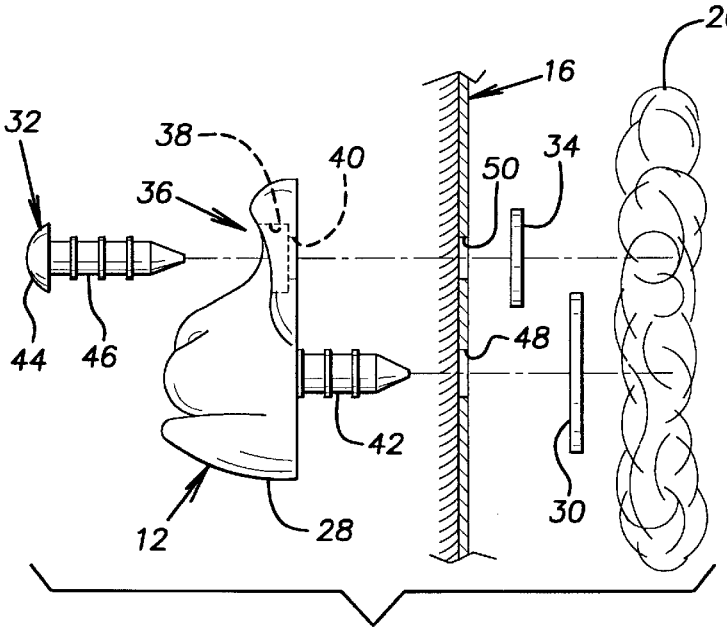
FIG. 2 is an exploded side elevational view of the hard face and a portion of the soft plush head of FIG. 1.
Figure 3:
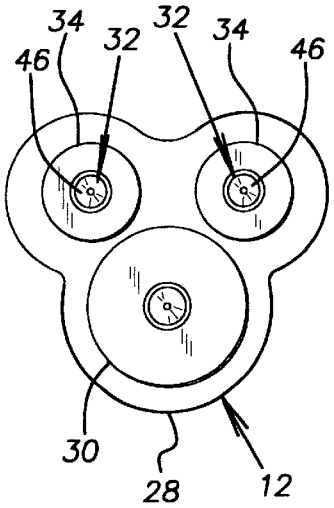
FIG. 3 a rear elevational view of the plastic face of FIGS. 1 and 2 with the soft plush head removed for clarity.

FIGS. 1–3 illustrate a plush-fabric stuffed toy or FIG. 10 having a hard face 12 according to the present invention. While the illustrated stuffed FIG. 10 is a monkey, it is noted that the stuffed FIG. 10 can alternatively form another primate, another animal, a human, a cartoon figure, a fantasy figure, a highly recognizable licensed figure, or any other desired figure. The illustrated three-dimensional stuffed FIG. 10 includes the hard face 12, a soft plush body 14, and a faceless and/or featureless soft plush head 16.

The plush body 14 and the plush head 16 are formed from planar blanks known in the art of appropriate configurations and dimensions to form the desired stuffed FIG. 10, such as the illustrated monkey. The illustrated plush body 14 includes a torso 18, a pair of legs 20, a pair of arms 22, and a tail 24. The planar blanks are preferably a fabric or knit or woven material preferably having a plush fur on one side such as, for example, acrylic pile, modified acrylic pile, cotton pile, cotton lycra pile, polyester pile, or nylon pile. Less preferably the blanks are not plush. The blanks are secured together to form the three-dimensional or contoured members each forming an internal cavity. The blanks are preferably sewn or stitched together and are preferably blind stitched with heavy cotton thread.

The cavities are preferably filled with stuffing material 26 as known in the art such as, for example, fiberfill. Fiberfill is used herein to indicate any material, natural or synthetic, providing an effective degree of loft or stuffing. A preferred fiberfill is synthetic wadding or batting such as a polyester fiberfill. The quantity of stuffing material 26 used depends on the nature of the stuffed FIG. 10.

The hard face 12 is firmly secured to the front of the faceless plush head 16 and includes a face body 28, a face locking washer 30, a pair of artificial eyes 32, and a pair of eye locking washers 34. The face body 28 has a first or front side which is contoured to give a sculptured appearance and preferably to form a detailed face and a second or rear side which is generally planar or concave to more closely conform to the surface of a round or spherical head. The front side is sized, shaped and colored to form the face of the stuffed FIG. 10 to provide a more realistic looking stuffed FIG. 10 than provided by plush faces.

The illustrated face body 28 has a mouth, a nose and a pair of eye sockets 36. The eye sockets 36 are sized and shaped to receive the artificial eyes 32 therein as described in more detail hereinafter. Each eye socket 36 has a recess 38 and a central opening 40 extending entirely though the face body 28.

A main or face locking pin or stem 42 perpendicularly extends from the rear side of the face body 28. The face locking stem 42 is preferably located near a lower end of the face body 28 opposite the nose and the mouth. The face locking stem 42 is preferably provided with threads or ribs which cooperate with the face locking washer 30 as described in more detail hereinafter.

The face body 28 and the face locking stem 42 are preferably formed or molded as one integral piece from a plastic or other suitable material. Alternatively the face body 28 may be plastic molded around a metal stem 42. Preferably, the face body 28 and the face locking stem 42 are molded or cast, but other suitable methods known in the art may be used. The hard face 12 is preferably rigid and stiff and is preferably polyvinylchloride, but other hard plastics, such as thermoplastics or thermosets, or other hard materials, such as metals, known in the art which give the desired details may be used. The hard face 12 is preferably colorized by painting or air brushing or the like to emphasize facial details on the front surface thereof.

Each artificial eye 32 includes an eye body 44 and an eye locking stem or pin 46. The eye body 44 has a first or front side which is generally hemispherical-shaped and a second or rear side which is preferably generally planar. The eye body 44 is sized and shaped to fit within the recess 38 of the face body 28 but not the opening 40 of the face body 28 so that the rear side of the eye body 44 engages the bottom of the recess 38 encircling the central opening 40.

The eye locking stem 46 is integral with the eye body 44 and perpendicularly extends from the rear side of the eye body 44. The eye locking stem 46 is preferably located at centerline of the eye body 44 and is sized to extend through the central opening 40 in the face body 28. The eye locking stem 46 is preferably provided with threads or ribs which cooperate with the eye locking washer 34 as described in more detail hereinafter.

The eye body 44 and the eye locking stem 46 are preferably formed as one integral piece from a plastic or other suitable material. The artificial eyes 32 are preferably thermoplastic or thermoset resin, such as PVC, but other suitable materials, such as metals, known in the art may be used.

The artificial eyes 32 are preferably separate from, that is not integral with, the face body 28 so that a separate material may be used. It is noted that various translucent plastics provide more natural looking eyes than painted eyes. The artificial eyes 32, however, can alternatively be integral with the face body 28.

The locking washers 30, 34 are sized to cooperate with the respective locking stems 42, 46 to be rigidly secured thereto for preventing accidental removal of the locking washers 30, 34 from the locking stems 42, 46. Preferably, there is an interference fit between the locking washers 30, 34 and the threads or ribs of the locking stems 42, 46. The locking washers 30, 34 are preferably sized to have a relatively large outer diameter so that they collectively engage a substantial portion of the rear side of the face body 28. Preferably, the three locking washers collectively engage at least 20, 30, 40, 50, 60 or 70 percent of the rear side of the face body 28. The locking washers 30, 34 are preferably formed from a resilient plastic such as, for example, a thermoplastic. The locking washers are shown as flat but may also have a raised or hemispherical central portion or be hemispherical, globular, or other shapes known in the art performing the locking function. Other locking washer devices known in the art for locking the locking stems 42, 46 in place can also be used.

As best shown in FIGS. 2 and 3, the hard face is secured to the plush head 16 by inserting the face locking stem 42 through an opening 48 in the plush material until the plush side of the plush material engages the rear side of the face body 28. Note that the opening 48 can be either preformed or pierced by the face locking stem 42 during insertion. The face locking washer 30 is placed onto the face locking stem 42 until it engages the inner side of the plush material to clamp the plush material between the rear side of the face body 28 and the face locking washer 30 and thereby securing the face body 28 to the plush material of the plush head 16. The face locking washer 30 is sized to cooperate with the face locking stem 42 to be rigidly secured thereto to prevent accidental removal of the face locking washer 30 from the face locking stem 42. Additionally, the face locking washer 30 can be secured to the face locking stem 42 by adhesives, heat fusion or the like to prevent their accidental separation.

The artificial eyes 32 with the eye locking stems 46 are preferably separate from the face body 28 and are placed into the empty eye sockets 36. Each artificial eye 32 is installed by inserting the eye locking stem 46 through the central opening 40 in the face body 28 and an opening 50 in the plush material until the eye body 44 is within the recess 38 and engages the bottom of the recess 38. Note that the opening 50 can be either preformed or pierced by the eye locking stem 46 during insertion. The eye locking washer 34 is then placed onto the eye locking stem until it engages the inner side of the plush material to clamp the plush material between the second side of the face body 28 and the eye locking washer 34 and thereby securing the artificial eye 32 and the face body 28 to the plush material of the plush head 16. The eye locking washers 34 are sized to cooperate with the eye locking stems 46 to be rigidly secured thereto to prevent accidental removal of the eye locking washers 34 from the eye locking stems 46. Additionally, the eye locking washers 34 can be secured to the eye locking stems 46 by adhesives, heat fusion or the like to prevent their accidental separation.

Note that by having a plurality of locking stems 42, 46, the hard face 12 is securely fastened to the plush material such that there is generally no relative movement therebetween either axially or rotationally. Also note that the artificial eyes 32 are within the recesses 38 of the face body 28 so that the artificial eyes 32 cannot be grasped and pulled from the front side of the hard face 12.

Once the three locking stems 42, 46 are secured to the plush head 16 with the locking washers 30, 34, the plush head 16 is then stuffed, preferably with polyester fiberfill 26, and stitched closed in the typical way. The plush head 16 is then stitched, preferably using heavy cotton thread, to the plush body 14 which has also been stitched closed and stuffed, preferably with polyester fiberfill.

From the above description it can be seen that the stuffed FIG. 10 is realistic looking by having a detailed hard face 12 while at the same time keeping the appeal of a soft touchable plush toy by having a soft plush body and plush head 14, 16. It can also be seen that the stuffed FIG. 10 is safe, easy to assemble, fairly inexpensive to produce, and very durable and break resistant.

Although particular embodiments of the invention have been described in detail, it will be understood that the invention is not limited correspondingly in scope, but includes all changes and modifications coming within the spirit and terms of the claims appended hereto.

What is claimed is:

1. A stuffed figure comprising:

a soft head formed of a fabric material and filled with stuffing material; and a hard face including a face body having a front side and a rear side, a plurality of locking stems rearwardly extending from said face body and through said fabric material, and a plurality of locking washers cooperating with said locking stems to clamp said fabric material between said plurality of locking washers and said rear side of said face body to secure said hard face to said soft head.

2. The stuffed figure according to claim 1, wherein said front side of said face body is contoured to form at least a mouth and a nose.

3. The stuffed figure according to claim 1, wherein said front side of said face body is contoured to form a pair of eye sockets.

4. The stuffed figure according to claim 3, wherein said hard face further includes a pair of artificial eyes located in said eye sockets, each of said artificial eyes having one of said plurality of locking stems rearwardly extending therefrom.

5. The stuffed figure according to claim 3, wherein each of said eye sockets includes a recess and an opening extending from a bottom of said recess to said rear side of said face body.

6. The stuffed figure according to claim 5, wherein said hard face further includes a pair of artificial eyes located in said eye sockets, each of said artificial eyes having an eye body located in said recess and having one of said plurality of locking stems rearwardly extending from said eye body through said opening.

7. The stuffed figure according to claim 6, wherein said recesses and said eye bodies are adapted such that said artificial eyes cannot be grasped from the front side of said face body.

8. The stuffed figure according to claim 1, wherein at least one of said locking stems is integral with said face body.

9. The stuffed figure according to claim 8, wherein said hard face further includes a pair of artificial eyes, each of said artificial eyes having an associated one of said plurality of locking stems rearwardly extending therefrom.

10. The stuffed figure according to claim 9, wherein each of said artificial eyes is non-integral with said face body and each of said artificial eyes is integral with its associated locking stem which extends through said face body.

11. The stuffed figure according to claim 1, wherein said hard face further includes a pair of artificial eyes, each of said artificial eyes having one of said plurality of locking stems rearwardly extending therefrom.

12. The stuffed figure according to claim 11, wherein each of said artificial eyes is non-integral with said face body and each of said artificial eyes is integral with its associated locking stem which extends through said face body.

13. A stuffed figure comprising:

a soft head formed of a fabric material and filled with stuffing material; and a hard face including a plastic face body having a rear side with a face locking stem rearwardly extending therefrom and through said fabric material, a pair of artificial eyes each having an eye locking stem rearwardly extending therefrom and through both said face body and said fabric material, and a plurality of locking washers cooperating with said face locking stem and said eye locking stems to clamp said fabric material between said plurality of locking washers and said rear side of said face body to secure said hard face to said soft head.

14. The stuffed figure according to claim 13, wherein said face body has a front side contoured to form at least a mouth, a nose, and eye sockets.

15. The stuffed figure according to claim 14, wherein each of said eye sockets includes a recess and an opening extending from a bottom of said recess to said rear side of said face body.

16. The stuffed figure according to claim 15, wherein each of said artificial eyes has an eye body and wherein said recesses and said eye bodies are adapted such that said artificial eyes cannot be grasped from the front side of said face body.

17. The stuffed figure according to claim 13, wherein said face locking stem is integral with said face body.

18. The stuffed figure according to claim 17, wherein each of said artificial eyes is non-integral with said face body and each of said eye locking stems is integral with one of said artificial eyes.

19. The stuffed figure according to claim 13, wherein each of said artificial eyes is non-integral with said face body and each of said eye locking stems is integral with one of said artificial eyes and wherein said plurality of locking washers collectively engage at least 30 percent of the rear side of said face body.

20. A stuffed figure comprising:

a soft head formed of a fabric material and filled with stuffing material; and a plastic face including a face body having a front side and a rear side, said front side contoured to form a mouth, a nose and eye sockets, a face locking stem integral with said face body and rearwardly extending therefrom and through said fabric material, a pair of artificial eyes each located in a separate one of said eye sockets and non-integral with said face body, each of said artificial eyes having an eye locking stem integral therewith and rearwardly extending therefrom and through both said face body and said fabric material, and a plurality of locking washers cooperating with said face locking stem and said eye locking stems to clamp said fabric material between said plurality of locking washers and said rear side of said face body to secure said plastic face to said soft head.

* * * * *